United States Patent [19]

Umezawa

[11] Patent Number: 4,788,815

[45] Date of Patent: Dec. 6, 1988

[54] STEEL CORDS FOR THE REINFORCEMENT OF RUBBER ARTICLES

[75] Inventor: Yujiro Umezawa, Tokyo, Japan

[73] Assignee: Bridgestone Corporation, Tokyo, Japan

[21] Appl. No.: 40,676

[22] Filed: Apr. 21, 1987

Related U.S. Application Data

[63] Continuation of Ser. No. 810,460, Dec. 18, 1985, Pat. No. 4,707,975.

[30] Foreign Application Priority Data

Feb. 26, 1985 [JP] Japan ..... 60-35215
Feb. 26, 1985 [JP] Japan ..... 60-35216

[51] Int. Cl.[4] ..... D07B 1/06
[52] U.S. Cl. ..... 57/212; 57/213; 57/902
[58] Field of Search ..... 428/592, 624, 625, 626; 57/213, 218, 230, 902, 212; 152/451, 527

[56] References Cited

U.S. PATENT DOCUMENTS

| | | | |
|---|---|---|---|
| 1,919,509 | 7/1933 | Grobl | 57/213 |
| 2,098,163 | 11/1937 | Reed | 57/213 |
| 3,318,082 | 5/1967 | Riggs | 57/218 |
| 3,413,799 | 12/1968 | Lejeune | 57/902 |
| 3,538,702 | 11/1970 | Wolf et al. | 57/902 |
| 4,349,063 | 9/1982 | Kikochi | 57/902 |
| 4,628,683 | 12/1986 | Bourgois | 57/902 |

*Primary Examiner*—John J. Zimmerman
*Attorney, Agent, or Firm*—Sughrue, Mion, Zinn, Macpeak, and Seas

[57] ABSTRACT

A steel cord for the reinforcement of rubber articles is disclosed, which comprises a central base structure composed of 1 to 4 steel filaments, and at least one coaxial layer composed of plural steel filaments arranged around the central base structure so as to adjoin them to each other, these steel filaments being twisted in the same direction at the same pitch. In the steel cord of this type, the steel filaments constituting the central base structure have the same diameter (dc), while at least one steel filament of the coaxial layer has a diameter (dso) smaller than the diameter (dc) of the steel filament in the central base structure.

7 Claims, 3 Drawing Sheets

STEEL CORDS FOR THE REINFORCEMENT OF RUBBER ARTICLES

This is a continuation of Ser. No. 810,460, filed on Dec. 18, 1985, now U.S. Pat. No. 4,707,975.

BACKGROUND OF THE INVENTION

1. Field of the Invention

This invention relates to steel cords usable for the reinforcement of rubber article bodies such as penumatic tires, industrial belts and the like. More particularly, it proposes an improvement in the steel cord of so-called compact structure composed of steel filaments in connection with developmental results for greatly enhancing the durable life of the rubber article by improving fatigue properties, particularly resistance to material fatigue and fretting wear, and strength retaining properties of the steel cord. It is particularly suitable as a reinforcement of pneumatic radial tires for truck, bus and light truck.

2. Related Art Statement

In a conventional pneumatic radial tire using steel cords as a reinforcement, the fatigue properties of the carcass ply and belt layer are degraded mainly by the following causes:

(1) Material fatigue due to repeated strain

It is a phenomenon that the material of steel cord is fatigued by subjecting the cord to repeated deformation during the running of the tire to vary the strain of steel filaments constituting the cord. This strain variate becomes conspicuous as the contact pressure (friction) between the filaments becomes large or the restraint on the movement of each filament becomes strong even if the deformation of the cord is the same, which brings about the promotion of material fatigue; and (2) Fretting wear in contact portion between mutual filaments This is due to the so-called fretting phenomenon. Additionally, there is sometimes caused a corrosion fatigue due to water penetrating from the outside of the tire. These fatigue factors considerably deteriorate the service durable life of the tire.

Heretofore, it has been considered that the penetration of rubber into the inside of the cord is primarily effective for enhancing the corrosion fatigue properties of the cord, and consequently there have been proposed many twisting structures for providing sufficient rubber penetration (, which are called as a rubber penetration structure). In such a rubber penetration structure cord, the rubber layer is interposed between the steel filaments, so that it is also considered to hardly produce the rubbing between mutual steel filaments or a so-called fretting wear.

The penetration of rubber into the inside of the cord is easily achieved in a single twisting structure cord used in a belt layer of a radial tire for passenger cars, wherein each of the steel filaments can completely be covered with rubber.

However, in case of multi-layer structure cords such as a two or three layer structure cord as used in the carcass ply or belt layer in tires for truck, bus or light truck it is very difficult to completely penetrate rubber into the inner layer of the cord.

When some of the steel filaments are not covered with rubber due to incomplete rubber penetration, the corrosion fatigue properties of the cord are not improved too much even in the rubber penetration structure.

In this case, it is necessary to make the helical radius of the steel filament large to provide a sufficient space between the steel filaments for obtaining complete rubber penetration. If it is intended to apply such a twisting structure (loose twisting structure) to the multi-layer structure cord, when the cord is pulled under tension, the setting of steel filaments becomes non-uniform and consequently it is difficult to avoid a fear that premature breaking failure is caused in certain portions of the filament due to the ununiform tension.

In the multi-layer structure cord, therefore, it is difficult to enhance the corrosion fatigue properties and strength retaining property (resistance to fretting) by rubber penetration into the inside of the cord.

On the other hand, Japanese Patent laid open No. 55-30499 has proposed a cord obtained by twisting plural steel filaments having the same diameter in the same twisting direction at the same pitch or a so-called compact cord, and discloses that such a cord is advantageous in view of the productivity.

However, the inventors have made studies with respect to the fatigue properties and found that under the same filament diameter such a compact cord (hereinafter referred to as a normal compact cord) such as $1\times12$ structure is fairly inferior in the fatigue properties to the conventional steel cord of $3+9$ structure.

As to repeated bending, Japanese Patent application publication No. 44-18385 discloses a method wherein the steel filament for an outer layer is made thinner than the steel filament for an inner layer in order to equalize the fatigue strength of the steel filament between the inner layer and the outer layer. The cord disclosed in this article comprises a center core and an outer cover composed of at least one wire layer or layer of strands each containing plural wires. In this type of the multi-layer structure cord, the twisting pitch is generally different between the inner layer and the outer layer, so that contacting between the mutual steel filaments approaches a point contact and consequently the contact pressure between the inner layer and the outer layer increases, this is apt to increase the strain of the filament or produce the fretting. Therefore, even if the filament diameter in the outer layer is made thin, the improving effect with respect to the above phenomenon can not be expected this is because the thinning of the outer diameter of the steel filament in the outer layer can reduce the strain in the bending deformation as compared with the case of using the steel filament of the original diameter, but it cannot control the phenomenon of increasing the strain due to the interaction between the steel filaments.

Among the aforementioned multi-layer structure cords, the normal compact structure having the same twisting pitch in each layer forms a complete line contact in the steel filaments between the inner layer and the outer layer, so that the contact pressure between the inner and outer layers produced when pulling the cord is small. Thus, the friction between the steel filaments in the bending deformation of the cord under tension becomes small, so that it is anticipated that the strain produced in the filament and the fretting are small and the corrosion fatigue properties and strength retaining property are good.

In the usual $3+9$ cord, gaps are opened in any portions between sheath filaments. On the contrary, in the normal compact structure, there is no gap between the mutual steel filaments in the outer layer or the sheath, while the gap is rather opened between the sheath and the inner layer or the core taking the ellipsoid in section of the steel filament into consideration. Hence the steel filaments are arranged so as to collide with each other in the sheath. As a result, when tension is applied to the normal compact cord, the contact pressure between the core and the sheath is certainly small, but a large contact pressure is produced between the adjoining steel filaments in the sheath and consequently cracks grow from the contact portion between the adjoining steel filaments as a fretting nucleus to lead the breakage of the steel filament. This is why the corrosion fatigue properties of such a cord become inferior to those of the usual 3+9 structure cord.

SUMMARY OF THE INVENTION

It is an object of the invention to improve the corrosion fatigue properties and strength retaining property of the steel cord with holding the uniform tension burden of each filament.

In order to provide the uniform tension burden, a closed twisting structure of a compact structure is adopted instead of a loose twisting structure. In this case, rubber hardly penetrates into the inside of the cord as previously mentioned. However, the twisting pitch is made same as compared with the loose structure to increase the contact area between the steel filaments in the core and the sheath, whereby the contact pressure between the core and the sheath is reduced. This has a drawback that the contact pressure is conversely increased in particular portion (i.e. between the adjoining steel filaments in the sheath) as previously mentioned.

The inventors have found that the above drawback is effectively solved by applying at least one steel filament having a diameter different from that of the core to the sheath to thereby enhance the corrosion fatigue properties of the steel cord.

According to the invention, there is the provision of in a steel cord for the reinforcement of rubber articles comprising a central base structure composed of 1 to 4 steel filaments, and at least one coaxial layer composed of plural steel filaments arranged around the central base structure so as to adjoin them to each other, these steel filaments being twisted in the same direction at the same pitch, the improvement wherein the steel filaments constituting the central base structure have the same diameter (dc), while at least one steel filament of the coaxial layer has a diameter (dso) smaller than the diameter (dc) of the steel filament in the central base structure and a ratio of dc/dso is within a range of 1.03 to 1.25.

In the preferred embodiment of the invention, the steel cord for the reinforcement of rubber articles comprises a central base structure composed of 2 to 4 steel filaments, and at least one coaxial layer composed of plural steel filaments arranged around the central base structure so as to adjoin them to each other, these steel filaments being twisted in the same direction at the same pitch, wherein the steel filaments constituting the central base structure have the same diameter (dc), while that steel filament in the coaxial layer which contacts with both the adjoining steel filaments of the central base structure has a diameter (dsi) equal to the diameter (dc) and the remaining steel filaments in the coaxial layer have a diameter (dso) smaller than the diameter (dc) and a ratio of dc/dso is within a range of 1.03 to 1.25.

BRIEF DESCRIPTION OF THE DRAWINGS

The invention will now be described with reference to the accompanying drawings, wherein.

DESCRIPTION OF THE PREFERRED EMBODIMENTS

Figure 1A:
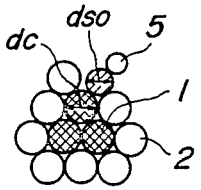
FIGS. 1*a* to 1*c*, 2*a* to 2*c*, 3*a* to 3*d* and 4*a* to 4*c* are sectional views of embodiments of the compact structure steel cord according to the invention, respectively.
Figure 1B:
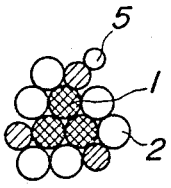
Figure 1C:
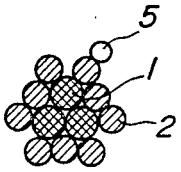
Figure 2A:
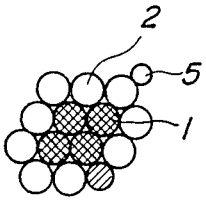
Figure 2B:
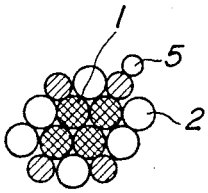
Figure 2C:
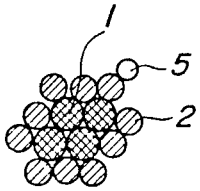

In FIGS. 1*a* to 4*c* are sectionally shown various embodiments of the steel cord for the reinforcement of rubber article according to the invention having a twisting structure of 1×12+1, 1×14+1, 1×27, 1×30, 1×19, 1×37, 1×10, 1×12 or 1×14, respectively. in these figures, 1 to 4 steel filaments represented by crossed oblique lines form a central base structure 1 (hereinafter referred to as a core). Nine steel filaments (FIGS. 1*a* to 1*c*) or ten steel filaments (FIGS. 2*a* to 2*c*) adjoiningly arranged around the core 1 forms a single coaxial layer 2 (hereinafter referred to as a sheath). In each of FIGS. 3*a* to 3*d*, the steel cord comprises a second sheath 3 and further a third sheath 4, each sheath being composed of plural steel filaments. Furthermore, eight to ten steel filaments form the single coaxial layer or the sheath 2 in FIGS. 4*a* to 4*c*, respectively. In any case, the steel filaments constituting the core 1 have the same diameter (dc), while at least one steel filament represented by an oblique line in the sheath 2 has a diameter (dso) smaller than the diameter (dc) of the steel filament of the core 1, wherein the ratio of dc/dso is within a range of 1.03–1.25. Particularly, in the sheath 2 of FIGS. 4*a* to 4*c*, the steel filaments each contacting with both the adjoining steel filaments of the core 1 are called an inner sheath 6 and have a diameter (dsi) equal to the diameter (dc) of the steel filament of the core, while the remaining steel filaments in the sheath are called as an outer sheath 7 and have a diameter (dso) smaller than the diameter (dc).

In general, when pulling the multi-layer structure cord, a force directing to the center of the cord acts to the helically formed steel filaments constituting the cord to produce a contact pressure between the mutual steel filaments in each layer. Such a contact pressure between the mutual steel filaments restrains the movement of steel filament by friction force when the cord is subjected to bending deformation, resulting in the increase of strain in steel filament and the occurrence of fretting wear at contact portion.

In case that the twisting pitch is Pc as a core and Ps as a sheath in the two-layer structure cord or Pc, $Ps_1$ and $Ps_2$ is the three-layer structure cord, the conventional multi-layer structure cords are frequently used at a twisting pitch ratio of Pc:Ps=1:2 (two-layer structure) or $Pc:Ps_1:Ps_2=1:2:3$ (three-layer structure). If such a twisting pitch ratio comes near to 1:1 in the two-layer structure or 1:1:1 in the three-layer structure, the steel filaments between the layers approach to a line contact and consequently the contact length becomes long and the contact pressure is reduced.

The contact length becomes longest when the twisting pitch in each layer is the same, i.e. in case of normal compact structure, and in this case the contact pressure is minimum.

In such a normal compact structure, fretting wear is considerably reduced between the inner layer and the outer layer (i.e. between the core and the sheath in two-layer structure, or between the core and the first sheath and between the first sheath and the second sheath in three-layer structure), but there is still a serious drawback of degrading the corrosion fatigue properties, as previously mentioned. That is, in the normal compact cord, the contact pressure between the adjoining steel filaments in the outer layer (sheath) is large, and violent fretting occurs at the contact portion as a nucleus to lead the filament breakage, which is a cause that the normal compact cord becomes inferior in the corrosion fatigue properties to the other conventional cords.

Figure 5:
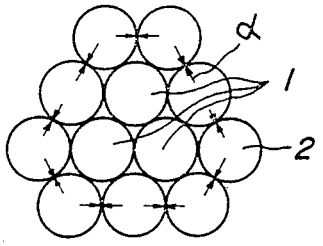
FIG. 5 is a diagrammatically sectional view illustrating the state of contact pressure between adjoining steel filaments of the outer layer in the conventional steel cord of normal compact structure.

Viewing the cross section of the normal compact cord, the sectional form of the steel filament is near an ellipse. The deviation from a true circle in the sectional form is larger in the steel filament for the sheath 2 having a larger twisting angle (i.e. an angle with respect to the longitudinal direction of the cord) than in the steel filament for the core 1. That is, the section of the normal compact cord cannot take an ideal densely-packed structure, so that the adjoining steel filaments in the sheath 2 collide with each other as shown by an arrow $\alpha$ in FIG. 5.

When pulling the normal compact cord, the force of the steel filament directing to the center of the cord falls on the contact point between the adjoining steel filaments in the sheath, which produces a large contact pressure.

Figure 3A:
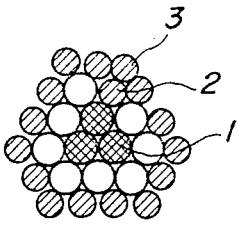
Figure 3B:
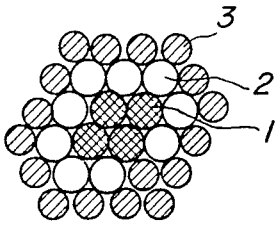
Figure 3C:
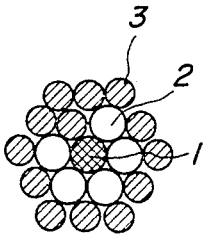
Figure 3D:
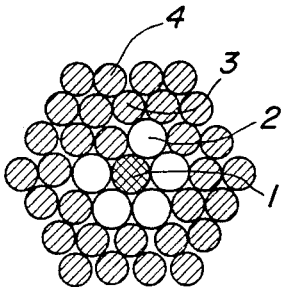
Figure 4A:
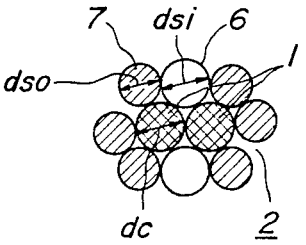
Figure 4B:
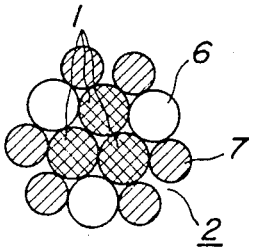
Figure 4C:
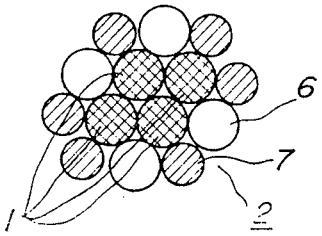

In order to mitigate the contact pressure produced between the adjoining steel filaments in the sheath 2, therefore, it is effective that the diameter of at least one steel filament in the sheath 2 as well as the second sheath 3 and the third sheath 4, see FIG. 3*d*, is made slightly thinner than that of the core 1 to form a gap between the steel filaments in each sheath.

The inventors have made various studies with respect to the corrosion fatigue properties of a compact structure cord composed of a combination of different diameter steel filaments when a tire comprising a carcass ply or a belt ply composed of such a compact structure cord is subjected to a drum test and confirmed that the fretting between the steel filaments in the sheath, which has been observed in the normal compact cord composed of the same diameter steel filaments, sharply decreases to largely enhance the corrosion fatigue properties in the compact structure cord composed of the combination of different diameter steel filaments.

According to the invention, the contact pressure between the core and the sheath and the contact pressure between the adjoining steel filaments in the sheath can simultaneously be mitigated by making the diameter of at least one steel filament in the sheath thinner than that of the core with this technique the corrosion fatigue properties of the cord can be enhanced as compared with those of the conventional cords.

In the steel cord according to the invention, it is essential that the ratio of dc/dso is within a range of 1.03–1.25, wherein dc is a diameter of a steel filament in the core 1 and dso is a diameter of at least one steel filament in the sheath 2 as well as the second and third sheaths 3, 4.

When the ratio of dc/dso is smaller than 1.03, the effect of reducing the contact pressure between the adjoining steel filaments in the sheath 2 is insufficient. When the ratio of dc/dso exceeds 1.25, there are the following drawbacks:

(1) If the diameter of the steel filament in the core 1 is too thick, the fatigue properties of the cord are unfavorably degraded, while if the diameter of the steel filament in the sheath 2 is made thinner without thickening the diameter of the steel filament in the core 1, the strength of the cord decreases so as not to hold the sufficient casing strength;

(2) All steel filaments of the sheath 2 are difficult to arrange in place and the poor twisting is apt to be caused; and (3) Fretting is apt to be locally caused and the corrosion fatigue properties are not enhanced sufficiently.

Figure 6:
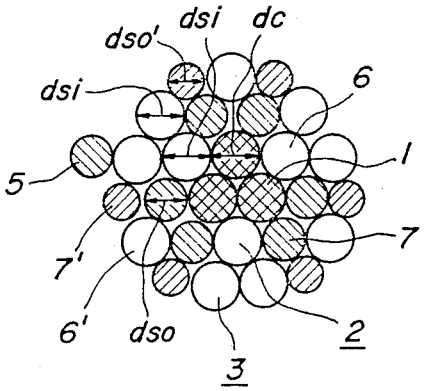
FIG. 6 is a sectional view of a modified embodiment of the steel cord shown in FIG. 4*b*.

The above facts are applicable to the cases of FIGS. 3*a* to 3*d* and FIG. 6 comprising second and third sheaths in addition to the cases of FIGS. 1*a* to 1*c*, 2*a* to 2*c* and 4*a* to 4*c* comprising the core 1 and the single coaxial layer or sheath 2. In FIGS. 1, 2 and 6, numeral 5 is a spiral wrapping filament, which is of course applied to the cases of FIGS. 3 and 4.

The following examples are given in the illustration of the invention and are not intended as limitations thereof.

EXAMPLE A

A pneumatic radial tire for truck and bus having a size of 1000R20 14PR was manufactured by using a steel cord as shown in the following Table 1 as a carcass ply at an end count of 17.5 cords/5 cm and then subjected to a drum test at a speed of 60 km/hr under an internal pressure of 8 kgf/cm$^2$ and a JIS 100% load. The corrosion fatigue properties and strength retaining property of the steel cord were measured by evaluation methods as mentioned later to obtain results as shown in Table 1, wherein Comparative Example 1 shows the case of conventional 3+9+1 twisting structure (control cord) and Comparative Examples 2 to 4 show normal compact cords of 1×12+1 structure, respectively. The measured values are represented by an index on a basis that the value of the control cord is 100.

TABLE 1(a)

| | Comparative Example 1 (control) | Comparative Example 2 | Example 1 | Example 2 | Example 3 | Example 4 | Example 5 |
|---|---|---|---|---|---|---|---|
| Structure | 3 + 9 + 1 | 1 × 12 + 1 | 1 × 12 + 1 | 1 × 12 + 1 | 1 × 12 + 1 | 1 × 12 | 1 × 12 + 1 |
| Twisting direction | S/S/Z | S/Z | S/Z | S/Z | S/Z | S | S/Z |
| Twisting pitch (mm) | 6.0/12.0/3.5 | 12.0/3.5 | 12.0/3.5 | 12.0/3.5 | 12.0/3.5 | 12.00 | 12.0/3.5 |
| Diameter of steel filament (mm) | core: 0.23 sheath: 0.23 spiral: 0.15 | core: 0.23 inner sheath: 0.23 outer sheath: 0.23 | core: 0.23 inner sheath: 0.23 five fila- | core: 0.23 inner sheath: 0.23 four fila- | core: 0.24 inner sheath: 0.225 outer sheath: 0.225 | core: 0.24 inner sheath: 0.225 outer sheath: 0.225 | core: 0.24 inner sheath: 0.24 three fila- |
| | | | ments of | ments of | | | ments of |

TABLE 1(a)-continued

| | Comparative Example 1 (control) | Comparative Example 2 | Example 1 | Example 2 | Example 3 | Example 4 | Example 5 |
|---|---|---|---|---|---|---|---|
| | | spiral: 0.15 | outer sheath: 0.23 one filament of outer sheath: 0.21 spiral: 0.15 | outer sheath: 0.23 two filaments of outer sheath: 0.21 spiral: 0.15 | spiral: 0.15 | no spiral filament | outer sheath: 0.24 three filaments of outer sheath: 0.22 |
| Diameter ratio dc/dso | 1 | 1 | 1.10 | 1.10 | 1.07 | 1.07 | 1.09 |
| Corrosion fatigue properties | 100 | 92 | 119 | 123 | 129 | 121 | 123 |
| Strength retaining property | 100 | 93 | 111 | 116 | 120 | 110 | 110 |

dc = filament diameter in core
dso = filament diameter of thinner steel filament in sheath TABLE 1(b)

| | Comparative Example 3 | Comparative Example 4 | Comparative Example 5 | Example 6 | Example 7 | Example 8 | Comparative Example 6 |
|---|---|---|---|---|---|---|---|
| Structure | 1 × 12 + 1 | 1 × 12 + 1 | 1 × 14 + 1 | 1 × 14 + 1 | 1 × 14 + 1 | 1 × 14 + 1 | 1 × 19 + 1 |
| Twisting direction | S/Z | S/Z | S/Z | S/Z | S/Z | S/Z | S/Z |
| Twisting pitch (mm) | 12.0/3.5 | 12.0/3.5 | 12.0/3.5 | 12.0/3.5 | 12.0/3.5 | 12.0/3.5 | 12.0/3.5 |
| Diameter of steel filament (mm) | core: 0.23 inner sheath: 0.23 five filaments of outer sheath: 0.23 one filament of outer sheath: 0.175 spiral: 0.15 | core: 0.24 inner sheath: 0.19 outer sheath: 0.19 spiral: 0.15 | core: 0.22 inner sheath: 0.22 outer sheath: 0.22 spiral: 0.15 | core: 0.22 inner sheath: 0.22 nine filaments of outer sheath: 0.22 one filament of outer sheath: 0.19 spiral: 0.15 | core: 0.22 inner sheath: 0.22 seven filaments of outer sheath: 0.22 one filament of outer sheath: 0.19 spiral: 0.15 | core: 0.22 inner sheath: 0.20 outer sheath: 0.20 spiral: 0.15 | core: 0.18 first sheath: 0.18 second sheath: 0.18 spiral: 0.15 |
| Diameter ratio dc/dso | 1.31 | 1.26 | 1 | 1.16 | 1.16 | 1.10 | 1 |
| Corrosion fatigue properties | 113 | 108 | 89 | 118 | 120 | 123 | 92 |
| Strength retaining property | 100 | 104 | 95 | 110 | 114 | 117 | 94 |

TABLE 1(c)

| | Example 9 | Example 10 | Comparative Example 7 | Comparative Example 8 | Example 11 | Example 12 | Comparative Example 9 |
|---|---|---|---|---|---|---|---|
| Structure | 1 × 19 + 1 | 1 × 12 + 1 | 1 × 12 + 1 | 1 × 10 + 1 | 1 × 10 + 1 | 1 × 14 + 1 | 1 × 14 + 1 |
| Twisting direction | S/Z | S/Z | S/Z | S/Z | S/Z | S/Z | S/Z |
| Twisting pitch (mm) | 12.0/3.5 | 12.0/3.5 | 12.0/3.5 | 12.0/3.5 | 12.0/3.5 | 12.0/3.5 | 12.0/3.5 |
| Diameter of steel filament (mm) | core: 0.19 five filaments of first sheath: 0.19 one filament of first sheath: 0.175 second sheath: 0.175 spiral: 0.15 | core: 0.24 inner sheath: 0.24 outer sheath: 0.225 spiral: 0.15 | core: 0.24 inner sheath: 0.24 outer sheath: 0.19 spiral: 0.15 | core: 0.25 inner sheath: 0.25 outer sheath: 0.25 spiral: 0.15 | core: 0.26 inner sheath: 0.26 outer sheath: 0.24 spiral: 0.15 | core: 0.22 inner sheath: 0.22 outer sheath: 0.20 spiral: 0.15 | core: 0.225 inner sheath: 0.225 outer sheath: 0.175 spiral: 0.15 |
| Diameter ratio dc/dso | 1.09 | 1.07 | 1.26 | 1 | 1.08 | 1.10 | 1.29 |
| Corrosion fatigue properties | 114 | 135 | 112 | 85 | 118 | 121 | 109 |
| Strength retaining | 108 | 124 | 103 | 92 | 112 | 116 | 104 |

TABLE 1(c)-continued

| | Example 9 | Example 10 | Comparative Example 7 | Comparative Example 8 | Example 11 | Example 12 | Comparative Example 9 |
|---|---|---|---|---|---|---|---|
| property | | | | | | | |

EXAMPLE B

A pneumatic radial tire for truck and bus having a size of 1200R20 18PR was manufactured by using a steel cord as shown in the following Table 2 as a carcass ply at an end count of 12.4 cords/5 cm and then subjected to the same drum test as described in Example A. The results obtained also shown in Table 2.

TABLE 2

| | Comparative Example 10 (control) | Comparative Example 11 | Example 13 | Example 14 | Comparative Example 12 | Example 15 |
|---|---|---|---|---|---|---|
| Structure | 3 + 9 + 15 + 1 | 1 × 27 + 1 | 1 × 27 + 1 | 1 × 27 + 1 | 1 × 27 + 1 | 1 × 27 + 1 |
| Twisting direction | S/S/Z/S | S/Z | S/Z | S/Z | S/Z | S/Z |
| Twisting pitch (mm) | 6.0/12.0/18.0/3.5 | 18.0/3.5 | 18.0/3.5 | 18.0/3.5 | 18.0/3.5 | 18.0/3.5 |
| Diameter of steel filament (mm) | core: 0.23 first sheath: 0.23 second sheath: 0.23 spiral: 0.15 | core: 0.23 first sheath: 0.23 second sheath: 0.23 spiral: 0.15 | core: 0.24 first sheath: 0.23 second sheath: 0.225 spiral: 0.15 | core: 0.24 five filaments in inner sheath of first sheath: 0.24 one filament in outer sheath of first sheath: 0.225 second sheath: 0.225 spiral: 0.15 | core: 0.24 first sheath: 0.19 second sheath: 0.19 spiral: 0.15 | core: 0.24 inner sheath of first sheath: 0.24 outer sheath of first sheath: 0.23 second sheath: 0.225 spiral: 0.15 |
| Diameter ratio dc/dso | 1 | 1 | 1.04 | 1.07 | 1.26 | 1.04 |
| dc/dso' | 1 | 1 | 1.07 | 1.07 | 1.26 | 1.07 |
| Corrosion fatigue properties | 100 | 90 | 132 | 117 | 108 | 128 |
| Strength retaining property | 100 | 95 | 118 | 114 | 98 | 124 |

dc = filament diameter in core
dso = filament diameter in first sheath (first coaxial layer)
dso' = filament diameter in second sheath (second coaxial layer)

EXAMPLE C

A pneumatic radial tire for truck and bus having a size of 1000R20 14PR was manufactured by using a steel cord as shown in the following Tables 3 and 4 as a belt ply at an end count of 19.7 cords/5 cm and an inclination angle of 18° with respect to the mid-circumference of the tire and then subjected to the same drum test as described in Example A. The results obtained are also shown in Tables 3 and 4.

TABLE 4

| | Comparative Example 15 (control) | Comparative Example 16 | Example 18 |
|---|---|---|---|
| Structure | 3 + 9 | 1 × 12 | 1 × 12 |
| Twisting direction | S/Z | S | S |
| Twisting pitch (mm) | 9.0/18.0 | 18.0 | 18.0 |
| Diameter of steel filament (mm) | core: 0.36 sheath: 0.36 | core: 0.36 inner sheath: 0.36 outer sheath: 0.36 | core: 0.36 inner sheath: 0.36 outer sheath: 0.34 |
| Diameter ratio dc/dso | 1 | 1 | 1.06 |
| Corrosion fatigue properties | 100 | 88 | 132 |
| Strength retaining property | 100 | 93 | 118 |

TABLE 3

| | Comparative Example 13 (control) | Comparative Example 14 | Example 16 | Example 17 |
|---|---|---|---|---|
| Structure | 3 + 9 + 15 + 1 | 1 × 27 + 1 | 1 × 27 + 1 | 1 × 27 |
| Twisting direction | S/S/Z/S | S/Z | S/Z | S |
| Twisting pitch (mm) | 6.0/12.0/18.0/3.5 | 18.0/3.5 | 18.0/3.5 | 18.00 |
| Diameter of steel filament (mm) | core: 0.23 first sheath: 0.23 second sheath: 0.23 spiral: 0.15 | core: 0.23 first sheath: 0.23 second sheath: 0.23 spiral: 0.15 | core: 0.24 first sheath: 0.23 second sheath: 0.225 spiral: 0.15 | core: 0.24 first sheath: 0.23 second sheath: 0.225 no spiral filament |
| Diameter ratio dc/dso | 1 | 1 | 1.09 | 1.09 |
| dc/dso' | 1 | 1 | 1.07 | 1.07 |
| Corrosion fatigue properties | 100 | 92 | 128 | 124 |
| Strength retaining property | 100 | 90 | 116 | 108 |

Evaluation Method

Corrosion fatigue properties (in case of applying to carcass ply):

After 300 cc of water was sealed in a space between an inner liner and a tube in the mounting of the test tire onto a rim, a service life of the test tire till the occurrence of cord breaking-up failure (running distance) was measured by the drum test, from which the index of the corrosion fatigue properties was calculated according to the following equation:

$$\text{Index} = \frac{\text{Service life of test tire using a trial steel cord (Running distance up to occurrence of burst)}}{\text{Service life of tire using control steel cord (Running distance up to occurrence of burst)}} \times 100$$

The larger the index value, the better the property.

Corrosion fatigue properties (in case of applying to belt ply):

When the tread of the tire is subjected to a cut failure during the running on rough road, water penetrates from the cut portion into the inside of the tire to cause the fracture of the cord in the outermost belt ply and the underlying belt ply due to the corrosion fatigue, finally resulting in the burst. Therefore, the cord for use in the belt is also required to have a high corrosion fatigue resistance or cord breaking property. In order to confirm the effect of the invention when applying the steel cord to the belt ply, the cord breaking property in the belt after the actual running on rough road was evaluated by manufacturing a test tire with a 3.5 belt structure wherein the steel cord to be tested was applied to the third belt ply. The evaluation was made after the tire was run on rough road over a distance of 30,000 km and then the recapped tire was again run thereon over a distance of 30,000 km (i.e. total running distance was 60,000 km).

After running, the tire was arbitrarily divided into six equal parts and the number of broken cords in the third belt ply was measured in anyone of the six equal parts, from which the index of the cord breaking property was calculated according to the following equation:

$$\text{Index} = \frac{\text{Number of broken cords on the control steel cord}}{\text{Number of broken cords on the trial steel cord}} \times 100$$

The larger then index value, the better the property.

Strength retaining property:

The strength retaining property is represented by the following equation:

$$\text{Strength retaining property} = \frac{\text{Strength retention of trial cord}}{\text{Strength retention of control cord}} \times 100$$

In the above equation, the strength retention of cord was calculated according to the following equation:

$$\text{Strength retention} = \frac{\text{Cord strength after running}}{\text{Cord strength before running}} \times 100$$

As mentioned above, according to the invention, the diameter of at least one steel filament in the sheath (or the coaxial layer) is made thinner than that of the core in the compact structure steel cord having the same twisting direction and pitch, whereby the contact pressure between the core and the sheath when pulling the steel cord can be reduced without producing a large contact pressure between the adjoining steel filaments in the sheath to thereby mitigate the strain of the steel filament and the fretting wear. Thus, the corrosion fatigue properties and the strength retaining property can considerably be improved.

What is claimed is:

1. A steel cord for the reinforcement of rubber articles comprising; a central base structure composed of 2 to 4 steel filaments, and only one coaxial layer composed of plural steel filaments arranged around the central base structure, the steel filaments of said coaxial layer and the central base structure being twisted in the same direction at the same pitch, the steel filaments constituting the central base structure have the same diameter (dc), while steel filaments of the coaxial layer have a diameter (dso) smaller than the diameter (dc) of the steel filament in the central base structure and a ratio of dc/dso is within a range of 1.03 to 1.25.

2. The steel cord according to claim 1, wherein said central base structure is composed of 2 steel filaments and said cord has 11 steel filaments in total including a spiral wrapping filament.

3. The steel cord according to claim 1, wherein said central base structure is composed of 3 steel filaments and said cord has 13 steel filaments in total including a spiral wrapping filament.

4. The steel cord according to claim 1, wherein said central base structure is composed of 4 steel filaments and said cord has 15 steel filaments in total including a spiral wrapping filament.

5. The steel cord according to claim 1, wherein said central base structure is composed of 2 steel filaments and said cord has 10 steel filaments in total.

6. The steel cord according to claim 1, wherein said central base structure is composed of 3 steel filaments and said cord has 12 steel filaments in total.

7. The steel cord according to claim 1, wherein said central base structure is composed of 4 steel filaments and said cord has 14 steel filaments in total.

* * * * *